US005836086A

United States Patent [19]

Elder

[11] Patent Number: 5,836,086

[45] Date of Patent: Nov. 17, 1998

[54] PROCESS FOR ACCELERATED DRYING OF GREEN WOOD

[76] Inventor: Danny J. Elder, Rt. 5, 110B, Kirbyville, Tex. 75956

[21] Appl. No.: 886,497

[22] Filed: Jul. 1, 1997

Related U.S. Application Data

[63] Continuation-in-part of Ser. No. 859,848, May 21, 1997.

[51] Int. Cl.[6] ..... F26B 7/00

[52] U.S. Cl. ..... 34/396; 34/417; 34/493; 34/497

[58] Field of Search ..... 34/396, 406, 413, 34/417, 443, 474, 475, 486, 493, 497; 427/254, 315, 317, 325, 398.1, 440, 444; 144/335, 364, 380; 62/331

[56] References Cited

U.S. PATENT DOCUMENTS

| | | | |
|---|---|---|---|
| 4,058,906 | 11/1977 | Pagnozzi | 34/406 |
| 4,246,704 | 1/1981 | Pagnozzi et al. | 34/92 X |
| 4,893,415 | 1/1990 | Moldrup | 34/406 |
| 4,922,624 | 5/1990 | Tharpe | 34/475 |
| 4,953,298 | 9/1990 | Carter et al. | 34/526 |
| 5,123,177 | 6/1992 | Koetter et al. | 34/69 |
| 5,269,076 | 12/1993 | Breckenridge | 34/413 |

OTHER PUBLICATIONS

Letter Dated Jan. 13, 1998 From Mr. Hans A. Ward, Manager of Kop–Coat Industrial Protection Products, To Mr. Mike Hollman TAN0177, 0118.

Letter Dated Feb. 28, 1996 from Eugene M. Wengert, Extension Specialist in Wood Processing, University of Wisconsin–Extension–Cooperative Extension, To Tanner Forest Products Corp. TAN0119.

Letter Dated 3 Mar., 1998 from Bernhard Kreber, Forest Research, To Mr. Paul Peace, Tanner Sawmills TAN0120.

Article in Southern Lumbermann Dated Mar., 1982 by Eddie W. Price Entitled "Chemical Stains in Hackberry Can Be Prevented" (3 Pages) TAN0123, 24, 25,.

Article Entitiled "Sapwood During Seasoning" in November, 1934 Issue of Hardwood Record (1 Page) TAN0126.

Article from Forest Products Journal, vol. 44–No. 10, Oct., 1994 Entitled "Methyl Bromide Fumigation To Control Non–Microbial Discolorations In Western Hemlock and Red Alder" by Bernhard Kreber, Elmer L. Schmidt, and Tony Byrne (1994).

Article Entitled "Chemical Brown Staining of Douglas–Fir Sapwood" by Donald J. Miller, Donald M. Knutson, and Richard D. Tocher, Dated Apr., 1983 TAN0135.

John McMillen et al., "Drying Eastern Hardwood Lumber", Agriculture Handbook No. 528, pp. 2–10, 61–67, Aug. 1990.

Eugene Wengert, "Drying Oak Lumber", University of Wisconsin–Madison, pp. 54–60, 112–115, Aug. 1990.

*Primary Examiner*—Henry Bennett
*Assistant Examiner*—Steve Gravini
*Attorney, Agent, or Firm*—Bush, Riddle & Jackson

[57] ABSTRACT

A process for drying or curing green wood including the heating of green wood in a heating enclosure to a predetermined temperature over about 120° F. while maintaining the moisture content of the wood close to the original moisture content of the felled wood, and then immediately cooling the heated wood with a cooling fluid at a temperature and humidity substantially less than the temperature and relative humidity of the heating enclosure for a time period sufficient for the wood to reach substantially the reduced temperature of the cooling fluid for normally removing at least about 5% of moisture from the green wood. The green wood is conditioned by the cooling step for subsequent drying steps in which moisture removal rates are substantially higher than moisture removal rates under prior conventional drying steps.

38 Claims, 1 Drawing Sheet

PROCESS FOR ACCELERATED DRYING OF GREEN WOOD

CROSS REFERENCE TO RELATED APPLICATION

This application is a continuation in part of application Ser. No. 08/859,848 filed May 21, 1997 and entitled "Process for Treating Green Wood."

FIELD OF THE INVENTION

This invention relates to a process to accelerate the curing or drying of green wood prior to fabrication of the wood into various wood products, objects, structures, or related items.

BACKGROUND OF THE INVENTION

All woods have a fibro-vascular tissue composed of cellulose and its components belonging to the subdivision called spermatophytes (IV) in the plant kingdom (with the single exception of tree ferns). The spermatophytes can be further subdivided into two classifications; gymnosperms or "softwoods" and the angiosperms or "hardwoods". It must be emphasized that the terms softwood and hardwood have no bearing on the density or degree of hardness of such woods but refers to their classification. Some woods that are classified as softwoods, such as yellow pine, are physically harder than some woods that are classified as hardwoods such as aspen or basswood. Further, agniosperms can be again divided into very distinct classes; the monocotyledons or the palms, bamboos, canes and grasses and the dicotyledons (the majority of angiosperms that provides us with useful woods).

Since a living tree contains very large amounts of water, lumbermen often refer at various stages from the initial cutting of a tree up through the sawing and drying of lumber to the moisture content ("MC") of the wood. The moisture content of the wood, usually expressed in a percentage, is a ratio of the amount of water in a piece of wood that is compared to the weight of such wood when all of the moisture has been removed. One of the methods that is employed (the "moisture content on the oven-dry basis") to determine the MC of wood at any stage during the lumber production process is to weigh a given sample of wood and record such weight (the "wet weight"). The sample is then placed into an oven and heated at temperatures not to exceed 217° F. until all of the moisture has been removed (the "oven dry weight") and that weight is recorded. It can be determined that the oven-dry weight has been reached when, after weighing at various intervals, the sample stops losing weight. The oven-dry weight is then subtracted from the wet weight and the resultant is then divided by the oven-dry weight. That resultant figure is then multiplied by 100 to determine the percentage of MC. The formula is represented as follows:

$$\% MC = \frac{(\text{wet weight} - \text{oven-dry weight})}{\text{oven dry weight of wood}} \times 100$$

The type of units employed for the above calculation, i.e. ounces, grams, pounds, kilograms, etc., is not important as long as all weights are recorded in the same type of units since the calculations are based upon a ratio of such weights. Other methods of determining MC have been developed as well as electronic machines that compute the MC based upon known electrical and other reactions. Regardless of the method employed to determine such MC, a working knowledge of moisture content and how it affects wood is important to the present process.

When a tree such as red or white oak, fir, maple, spruce, ash or any one of the many species of trees that yield wood that is useful in the production of wood products is initially cut down, it has a MC of anywhere from about 60% to 100% (this moisture content has been found to be even higher, as much as about 200% for some species). This is called the "green moisture content" ("GMC"). Opposed to popular belief, the green moisture content does not vary greatly with the season that a log is cut. This moisture or water has to be removed or dried from the wood in order to make the wood stable and thus usable in any phases of the lumber industry that require either air dried and/or kiln dried lumber. The drying or curing of green wood thus comprises the controlled removal of water from the wood to a level where the wood becomes sufficiently stable for fabrication into various products. The "curing" process or "curing" as used herein refers to moisture removal by the controlled act of air drying, kiln drying, or a combination of both.

After a tree is felled and is sawn into lumber of various sizes and types, it is stacked in a particular manner in preparation for the drying and/or pre-drying process. During this curing process, many problems may occur that can either damage, destroy or degrade the quality of the wood and render it less desirable and in some cases, not usable at all. The sawn lumber can develop cracks in the ends ("end checks"), cracks in the internal portions of the lumber ("honeycomb" or "honeycombing"), cracks in the surface ("surface checking"), as well as many types of warps and bends ("cup", "bow", "crook", etc.). Such problems are all related to the presence of moisture in the wood itself and the movement of, and subsequent removal of, such moisture from the time a tree is felled until the completion of the curing process. The significance of the removal of moisture during the curing process[s] becomes more understandable through a thorough understanding of the actual structure of wood itself.

The layers in a typical tree are: a) the outer bark; b) the inner bark; c) the cambium layer; d) the sapwood and e) the heartwood. The outer bark is a rough textured layer composed of dry, dead tissue that provides the tree with its first line of defense against external injury and insect infestation. The outer bark is separated form the next layer called the inner bark by a thin layer called the bark cambium. The inner bark is a soft, moist layer that contains living cells that play a role in the transfer of food to the growing parts of the tree. The cambium layer is a very small microscopic layer that is just inside the inner bark. The main function of the cambium layer is to produce both bark and wood cells.

The sapwood is composed of light colored wood and is made up of both living and dead tissues. The heartwood is the central section of the tree that is laden with resins and tannins and is basically inactive. Heartwood is formed by the transformation of sapwood as the tree ages. Both the sapwood and the heartwood are composed of many layers or "rings". These are called annual rings and each one represents the amount of growth a tree undergoes for a given year of its life. The heartwood is less permeable than that of sapwood and subsequently needs more drying time and is subject to more drying defects than sapwood. The infiltration of resins, gums and other materials in the heartwood make it more resistant to moisture flow and also make such heartwood darker in color.

The internal structure of wood is basically oriented around the flow of moisture since a tree distributes the nutrients it requires for growth in a liquid medium or sap. A basic element of such internal structure is the wood cell. There are two basic distribution processes that sap movement can occur in a tree. Such processes are called diffusion and conduction. In a wood cell, diffusion occurs when sap passes through the cell walls by the action of the protoplasm which covers cells that are rather new or young. Conduction occurs when the cells age somewhat and lose their protoplasm and develop pits or spot through which, sap passes easily. As some cells age, they might also break down at the ends and form tracheal vessels, sometimes referred to as the "through passageways", which utilize conduction as a transfer medium. The basic unit of a tree or the wood cell is characterized by different elements that utilized either one or both of such distribution methods. Each wood cell has a cell wall structure composed of several different layers and a central cavity. The cell wall is composed of lignin, cellulose and hemi-celluloses. These wood cells which are tube-like in shape have different functions dependent upon their particular anatomical construction. The tracheal vessels are longitudinal tubes composed of dead material. They are relatively long and large in diameter and play a role in the upward conduction of sap. The tracheids, closely related to the tracheal vessels, are somewhat narrower and shorter and also play a role in the upward conduction of sap. Tracheids provide a function as mechanical tissue, especially in woods that lack wood fibers, such as coniferous woods. Wood fibers are longitudinal strands of thick walled cells (long and pointed) which are lignified and are usually of dead material. Parenchyma cells are present in wood and medullary rays and are therefore longitudinal and radial. Parenchyma cells move sap by both conduction and diffusion and work as the food digestion and storage of organic materials, including oil, sugar, starch, etc. The only place in wood where air spaces occur between the cells is between parenchyma cells.

There are other types of anatomical elements that are important, and affect the flow of moisture within the wood. One such element is referred to as a pit and exists in several forms. Pits are small, valve-like openings that connect wood cells thereby becoming an important means of water transfer. Tracheids develop what is referred to as a "bordered pit" or a thin spot through which sap can pass more easily from cell to cell. As the walls of some tracheids become lignified, there is an increase of permeability to water as cell walls containing lignin allow a more free passage of water and do not swell as much as non-lignified cell walls. The pits however can become encrusted with certain substances that obstruct the flow of water and become in effect, clogged. Additionally, a characteristic referred to as "aspiration" can occur in some woods during the curing process to cause a restriction to the flow of water thereby to extend the curing period.

Another anatomical element, the tyloses, play a role in the movement of sap throughout the body of the tree and therefore affect the curing process. Tyloses are sac-like portions of the parenchyma cells that have pushed through the pits and moved into the cavities of the tracheids and tracheal vessels. Sometimes they become so numerous in certain species of wood that they obstruct the circulation of sap and can totally block up such movement of sap except in the outer portions of the sapwood. Since tyloses do not have a distinct nucleus of their own, they are not different cells but are an outgrowth from a medullary ray or parenchyma cells that expands into an empty cavity of a tracheal vessel. Since tyloses restrict circulation of sap within the wood, then woods that are high in tylose content, i.e. white oak, will have reduced permeability. In contrast, a wood that is lower in tylose content such as red oak, which usually has no tyloses in its tracheae, is more permeable.

Other anatomical features of a tree that are related to the movement of moisture within the wood are the medullary rays or "pith" rays which radiate out from the pith or central core of the tree stem. Unlike other cells in the tree, the medullary rays are perpendicularly aligned with the tree stem instead of longitudinally as are most other type of wood cells. In some types of trees, the medullary rays are quite conspicuous such as oak, beech and sycamore and compared to others, such as pines and conifers, such rays are microscopic. The medullary rays consist largely of parenchyma cells that are used in the conduction of food and nutrients to the cambium layer where such elements are used in the formation of new tissue. During the curing process for wood, water flow is usually faster around medullary rays than in surrounding cells making this part of the wood dry faster. Additionally, medullary ray cells are typically weaker. Species such as oak and beech which have large, pronounced rays have traditionally needed to have special care during the curing process to prevent checks, honeycombing and splits around such ray cells.

The dissection and nomenclature of wood therefore, plays a major role in the curing process since the anatomical structure of different species of wood all seem to be related to the restriction or movement of moisture in some manner or form. From the moment that a tree is felled, some form of moisture loss begins to take place from the sawn ends, the cuts to remove the limbs, abrasions that removed the bark, etc. All woods lose or possibly gain moisture in an attempt to reach a state of equilibrium with the moisture present in the surrounding air. As wood loses moisture, it begins to shrink and develop internal stresses which are relieved by the formation of cracks. Because moisture moves much faster from the cut ends of the wood than from the side or edge grains, then end checks or splits will occur within a very short time if a substantial moisture loss occurs from such ends. Usually, if the tree is sawn into lumber within a relatively short period after being felled, such as one week, such incidental moisture loss is not significant. However, if ambient conditions are very hot and dry, long holding periods for logs have to be accompanied by watering the logs to retard moisture loss or by waxing or coating the cut ends, limb cuts and other abrasions. Once the protective bark is removed and the log is cut into lumber, the moisture migration begins. Such moisture migration from lumber must be controlled and restricted in order to prevent drying defects.

Under conventional practices, as a given log is sawn into lumber, the individual boards of uniform thickness are stacked with spacing between them with precisely sized and positioned spacer boards or "stickers" usually about ¾"×¾"×48" long between the layers (a process known as "stickering" in the industry). Stickering promotes an even amount of exposure to the atmosphere (either natural or created) within the bundle or stack that has been created. The ends of each board are then end coated with a special form of wax, or such other suitable coating, to retard end checking because of the accelerated movement of moisture from the end grain of all woods (as compared to moisture movement from a side or edge grain). The bundle is normally pre-dried or air dried by placing the bundle in an area of controlled exposure to air, heat, and moisture to permit a controlled escape of moisture necessary for the "pre-drying" or "air-drying" phase. The pre-drying phase is effective to remove some or all of the "free" water that is present in the cells of the wood itself. In some instances, however, the pre-drying phase may be omitted. As used in the specification and claims herein, "free" water is defined as that moisture contained within the cell cavities of the wood. Because such free water is held less tightly than the remaining moisture or water in the wood, less heat energy is required to remove such free water during the subsequent kiln drying process applied after the pre-drying or air-drying phase. This is in contrast to "bound" water which is defined as that water that is contained within the cell walls themselves and requires higher application of energy to affect moisture reduction to a predetermined level. Most of the drying defects and problems associated with kiln dried lumber occur during the removal of the bound water.

The removal of free water brings the subject wood to a critical level in kiln drying known as the "fiber saturation point". As used herein, the term "fiber saturation point" is defined as the point where the cell walls are still saturated and all of the free water has been removed from the cell cavities. For most purposes the fiber saturation point is about 30% although it may be different for some species (possibly lower). Since wood dries from the outside to the inside (primarily by diffusion and/or capillary action), there is usually a differential between the MC of the surface of a board and the interior MC during the curing process. This differential, called a "gradient" between the inside MC and the outside MC, is usually between 15% to about 45%. Even though the average MC might be 30%, many of the interior cells might not be at the fiber saturation point. Since it has been established that the removal of the bound water causes many of the problems associated with the curing process, it is important to determine when the fiber saturation point is reached.

The "equilibrium moisture content" ("EMC") is another important factor that is conventionally used in the curing of woods. As used herein, the equilibrium moisture content is defined as that point at which the MC of a given board reached a balance with the outside temperature and relative humidity (the surrounding atmosphere of such board or the "RH"). There are other factors that could have a small effect on the EMC, such as the wood species or previous moisture content, for example. Conventional kiln drying includes a continuous manipulation of temperature and relative humidity to keep the progression of the change in EMC at a pre-determined rate of reduction. During the curing period, the relative humidity is constantly monitored. The relative humidity can be determined and monitored by several different methods employing different types of equipment. A common method to determine relative humidity is by the use of a wet-bulb thermometer simultaneously with a dry-bulb thermometer. A wet-bulb thermometer is a standard thermometer that has the sensor portion covered by a muslin wick that is kept wet with water. A dry-bulb thermometer conversely is the same temperature sensing device less the wet muslin wick. By monitoring the difference in temperature between the wet-bulb and dry-bulb thermometers (the "wet-bulb depression") and knowing the dry-bulb temperature, a chart can be consulted to determine the relative humidity of the air. Although other methods of determining the RH are effective, the wet bulb/dry bulb method is used with this invention.

The terms including their definitions as set forth above for the curing process are utilized in the conventional curing of wood and are important in understanding the forces that move moisture within a given piece of wood. These forces, primarily by diffusion and capillary action, when not controlled, cause most of the drying defects: i.e. cracks, surface checks, end checks, cups, bows, bends and other types of warps; honeycombs and honeycombing. Conventional curing techniques require complicated controls to inhibit the movement of moisture to prevent such defects from happening. As indicated above, wood dries from the outside in, therefore uncontrolled or rapid drying can cause a situation where the outside of a board dries too rapidly and is permanently "set" causing a situation known as "case hardening". As drying continues, the interior of the board develops core stresses that are unable to contract, thereby developing interior cracks (honeycombs or honeycombing). Because of this effect, the thickness of a given board being cured is of particular importance to such curing processes.

In the drying of wood, particularly a relatively thick lumber item, the rate of drying from the surface region is faster than from the interior. Thus, the surface regions are dried to the fiber saturation point at which shrinkage begins before the inwardly adjacent regions begin to shrink. The surface tries to shrink but the shrinkage is opposed by the nonshrinking adjacent regions. A stress is set up which may result in structural defects, such as checking, cupping, twisting, or warping. Also, if the surface regions become quite dry, both heat and mass transfer are reduced. It is thus necessary to maintain the surface regions as moist as possible relative to the rest of the wood to reduce degrading and defects. Normally this is accomplished by controlling the humidity of the circulating air so that equilibrium between the vapor pressure of air and that of the wood maintains a high moisture content of the wood. However, high equilibrium moisture contents are established only under conditions of high relative humidity which may be difficult to obtain.

The drying of woods, especially when the variety of species are considered, is a very specialized and exacting process. Very complex pre-drying and kiln drying schedules, most of which are effective only for a given locality and climate, have been normal heretofore for the wood drying industry.

Heretofore, and particularly for hardwoods, a pre-drying phase is often utilized for reducing the MC in the wood to an acceptable level prior to kiln drying normally by the slow removal of the MC over several days or more. It has been accepted heretofore that the MC of hardwood should not be reduced more than about 2½% a day for oak and similar species in order to minimize any drying defects or problems that may develop from the kiln drying process where high heat is utilized. An average of about 1¾% reduction in MC for oak and similar species of hardwood in a 24 hour period has been normal heretofore. The pre-drying phase is normally effective for reducing the MC at least 20% and may be over a period of several days or several weeks. A common pre-drying phase comprises placing the cut lumber which has been stickered in open air for a period of several days or weeks before the kiln drying. Generally, the pre-drying phase does not utilize any artificial or generated heat but utilizes ambient condition or heat for effecting the pre-drying phase. Green wood has a MC of at least about 60% when the tree is felled and the loss of moisture by air-drying and other processing is effective to reduce the moisture content at least about 20% prior to kiln drying.

Heretofore, starting from the felling of a tree, it has been common to reduce the moisture content of the green wood as quickly as possible. No attempt has been made heretofore to maintain the moisture content (MC) of the green wood as close as possible to the original MC of the wet log. Accepted practices have restructured the amount of MC that could be removed from the green wood over a twenty-four (24) hour period to about 2½% for oak and similar species of hardwood so that drying defects and other problems that develop from the kiln drying process do not occur. An average MC removal for hardwood of about one to 1½% is normal for a Southern climate. For commercial usage, the moisture content for hardwood that is made into furniture or similar wood products is reduced to a final MC of between 6% to 10%. The moisture content of softwoods, such as those used in the construction industry for homes and buildings is required to be reduced to a final MC between 15% and 20%. Thus, drying times for kiln drying, particularly for hardwoods, normally have been several days. As most drying procedures heretofore do not attempt to retain the MC of the log after felling, the MC of the lumber after pre-drying is generally less than about 35% to 50%, particularly for hardwoods. The kiln drying is then effective to reduce the MC to a total MC of between 6% and 10% for most hardwoods, and a total MC of between 15% and 20% for most softwoods.

Many softwoods, such as southern yellow pine, as well as some hardwoods such as appalachian oaks, for example, do not undergo a pre-drying phase and often are placed directly in a dry kiln within a few days after cutting from the forest. In this event, the original MC in the pine wood has not been reduced over about 10% to 15%. Yet the time for curing the pine softwood in a dry kiln is about two (2) to three (3) days by heating the wood to about 180° F. to 210° F. and maintaining the heat at this level throughout the drying schedule.

The preventing of stain in wood, particularly hardwood is desirable since hardwood is usually utilized for furniture. Sawn lumber develops several types of stains which occur during the drying process. Most stains occur between the time that a tree is felled and during the drying process. Stains form a substantial problem, particularly for hardwoods which are utilized for furniture.

Such stains fall into two very troublesome classes of stains, sap stain or blue stain caused by a fungus and chemical stains caused by the action of enzymes that are contained in the wood. Blue stain is a fungal stain that occurs in the sapwood of the tree. The sapwood comprises the living layers (parenchyma cells), growing layers (cambium layer) and semi dormant cells which take part in the life processes of the tree that surround the heartwood. The heartwood contains stabilized cells that are hardened and laden with tannin, natural chemicals and resins. The stability of the cells in the heartwood and the presence of tannin, as well as the lack of the sugars and starches, prevent the intrusion of the discolorations due to the blue stain and the chemical stains in such heartwood cells.

Blue stain is caused by fungal activity which is promoted by four main elements. Those elements are: a) temperature above 50° F. (a reason that blue stain is more troublesome in the southern United States); b) presence of oxygen; c) presence of moisture; and d) presence of sugar and starch occurring naturally in living cells of the sapwood. The elimination of one of these elements is normally effective to control blue stain.

Chemical stains such as sticker stain, sticker shadow and interior graying also occur in the sapwood and are caused by the oxidation of enzymes that are present in the living cells of the sapwood fibers. The control of chemical stains is effected by controlling the exposure of oxygen to the sawn lumber and the completing of the drying cycle of the wood as quickly as possible. However, drying schedules that are presently used have not been very effective in preventing stain growth. My prior application Ser. No. 08/859,848 filed May 21, 1997 is particularly directed to the preventing or minimizing stain in green wood.

Reissue Pat. No. RE28,020 reissued May 28, 1974 discloses a kiln drying process designed to reduce the kiln residence time with minimum structure stressing. The rate of moisture removal is maintained substantially constant, or accelerated constantly, over the drying period. The temperature of the heating fluid is increased above the temperature of the wood and this condition is maintained until the moisture content of the wood is reduced to the desired level. The RE28,020 patent does not show any reduction in the temperature of the heating fluid to a temperature below the temperature of the wood during the drying process for removal of internal heat from the wood, and does not show the exposure of the wood after heating to an outside cooling fluid surrounding the wood for reducing the temperature and humidity of the wood to the temperature and humidity of the outside cooling fluid.

It is an object of this invention to provide a process for the accelerated curing or drying of green wood that substantially reduces the curing time while providing minimal drying defects, such as checking or warping.

It is a further object of this invention to provide a process for the accelerated curing or drying of green wood that is also effective in preventing or minimizing staining of the wood.

SUMMARY OF THE INVENTION

The present invention is directed to an accelerated drying or curing process for the reduction of moisture in green wood to a predetermined moisture content with minimal structural stress in the wood. The accelerated process utilizes green wood that is placed within an enclosure or a confined zone having a moisture content (MC) that is very close of the original moisture content that the wood had when it was felled with no more than a 10% reduction occurring in the green wood before being in position within the enclosure for heating. The term "wood" as used herein, is intended to include wood in any form of logs, posts, poles, lumber, boards, timber, railwood cross ties, veneer, and strips as well as other known wood products.

The green wood having substantially its original moisture content is first heated in an enclosure to a predetermined temperature preferably above about 150° F. for a predetermined period of time sufficient to provide a generally uniform heating across the entire cross-section of the wood with moisture applied during the heating of the wood at substantially zero wet bulb depression to prevent or minimize any loss of moisture. The green wood is initially heated as soon as feasible after being felled and without utilizing any pre-drying steps. After the wood has been heated to the predetermined temperature, the temperature is maintained for a predetermined time dependent primarily on the wood species and whether staining may be a problem. In the event hardwoods to be utilized for furniture are being cured, the maintenance of the target temperature in the heating zone or enclosure for at least about two (2) hours is desirable for preventing or minimizing stain. The heating fluid is normally steam although other types of heating fluids could be utilized effectively, such as heated water or heated oils.

After the initial heating of the wood, the wood is exposed to a cooling fluid as soon as possible after heating of the wood and without at least thirty (30) minutes for best results. The cooling fluid surrounds the wood and is of a temperature and humidity substantially less than the temperature and humidity of the heated wood for the transfer of internal heat and moisture to the cooling fluid with the wood being exposed to the cooling fluid for a sufficient time period so that the wood obtains substantially the temperature of the surrounding environment with at least about 5% of the moisture being removed from the wood after being cooled by the cooling fluid. The cooling fluid has a temperature at least about 30° F. below the temperature of the heated wood for minimal results and preferably has a temperature about 50° F. below the temperature of the wood for best results. The temperature of the wood is reduced to the temperature of the cooling fluid and the MC of the wood is normally reduced at least about 5%. The cooling fluid preferably utilizes ambient air and may be applied by exposing the wood to outside ambient conditions or by having a blower providing ambient air from the outside environment. If ambient conditions are not satisfactory, artificial air conditioned by a suitable air conditioning unit may be utilized as the cooling fluid. The air or cooling fluid surrounds the green wood and results in an unexpectedly high removal of moisture during the cooling process without sustaining any drying defects. The cooling fluid effects a moisture loss in the green wood of at least about five 5% and conditions the wood for an unexpectedly rapid removal of moisture upon subsequent treatment of the green wood. The amount of moisture content loss by the green wood during the cooling step is directly proportional to the amount of change from the target heating temperature and humidity in the heating zone or enclosure.

The cooling step after the heating of the wood is sometimes referred to hereinafter as the "flash off" step including a flash off temperature for the cooling fluid and a flash off relative humidity for the cooling fluid. The flash off step is essential to the process of the present invention and results in an increased permeability of the wood which is maintained at least throughout the entire drying process until the final MC of the green wood is reached. Thus, practically all of the drying or curing steps applied after the flash off step result in a MC loss greater than obtained heretofore by conventional drying steps. After completion of the cooling or flash off step, the green wood is subjected to further drying steps for the removal of moisture until the final predetermined MC in the green wood is reached. The additional curing steps normally involve reheating of the wood to a predetermined high temperature although in some instances when drying time is not critical, air drying in a natural environment may be utilized with increased moisture removal as compared with air drying without the application of the flash off step. Also, the flash off step may be performed as a pretreatment step prior to placing of the wood in a conventional dry kiln for conventional drying steps. Normally, after the flash off step the green wood is reheated in a suitable heating zone or enclosure to a predetermined temperature with substantially improved moisture loss rates as a result of the conditioning of the green wood by the cooling step to increase permeability of the wood. The web bulb depression is gradually and progressively increased during the reheating of the wood after being cooled. In some instances, it may be desirable to repeat the initial heating and cooling flash off step as the moisture content can again be substantially reduced by repeating the heating and cooling flash off step. Air drying after such a heating and cooling flash off step has also been effective in removing increased amounts of moisture over a specified time period.

Another advantage in the present invention is a reduction in the shrinkage of the wood. Normally, the shrinkage of pine and most hardwoods is about 5% to 9%. Under the process of the present invention, shrinkage in pine and most hardwoods has been reduced to about 2% to 4%.

Other objects, features, and advantages of this invention will be apparent from the following specification and drawing.

DESCRIPTION OF THE INVENTION

Figure 1:
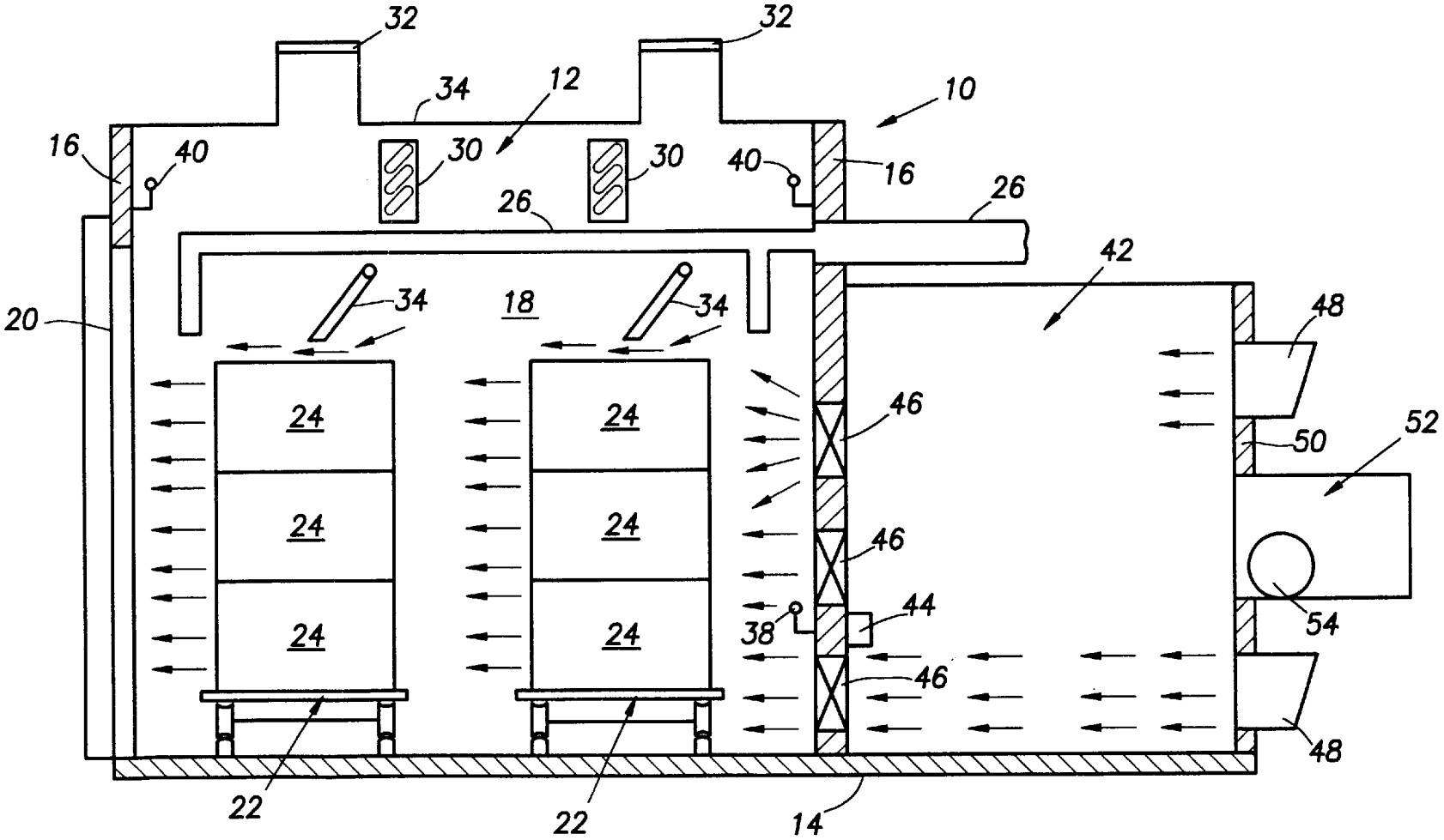
FIG. 1 is a generally schematic view of an apparatus suitable for carrying out the process of this invention.

Referring to FIG. 1, a heating chamber or kiln is shown schematically suitable for carrying out the curing or drying process of the present invention. The kiln is illustrated generally at 10 having an enclosed chamber 12 for treatment of the green wood. A base or foundation 14 for chamber 12 supports a pair of side walls 16 and end walls 18. Suitable doors 20 are provided in end walls 18 and on one side wall 16. Doors 20 which may comprise several door sections are mounted for movement between open and closed positions. Wheeled cars 22 are mounted on rails secured to foundation 14 and rectangular stacks or bundles 24 of stickered lumber are supported on cars 22 for curing and drying within enclosed chamber 12 by the present process.

For heating chamber 12 and for providing the desired humidity, a steam line 26 from a suitable steam boiler (not shown) extends to a suitable manifold for a plurality of inner steam lines 28 within chamber 18. Heating coils 30 are also provided for additional heat if desired or for heating separately. Ventilators 32 extending through the roof 34 may be opened and closed as desired. Hinged deflectors or baffles 34 are provided at various locations within chamber 12 for directing the air flow to rectangular lumber stacks 24 and preventing the air flow from short circuiting or being directed away from stickered lumber stacks 24. A wet bulb thermometer is shown at 38 and dry bulb thermometers are shown at 40.

An adjacent control room for kiln chamber 12 is shown generally at 42 for an operator. A recording instrument is shown at 44 to monitor and record the wet bulb temperature and the dry bulb temperature from thermometers 38 and 40. Mounted in side 16 are a plurality of fans 46 mounted in openings in wall 16. The openings in wall 16 for fans 46 are closed by suitable movable covers when fans 46 are not in operation. Outside vents 48 to atmosphere are provided in an outside wall 50 of control room 42. An air conditioning unit is shown at 52 and has a fan 54 for the supply of cool air at a predetermined temperature and relative humidity, if desired. In some instances, particularly where freezing ambient conditions are involved, it may be desirable to heat the ambient air to a predetermined temperature. Fans 46 are effective to supply ambient air from the outside atmosphere or refrigerated air to chamber 12. Also, if desired, refrigerated cooling lines could be mounted within the walls defining treatment chamber 12. The use of ambient air has been found to be economical and has functioned in a satisfactory manner under average ambient conditions without the use of any refrigerated cooling air for the treatment chamber 12. While fans 46 have been illustrated as positioned in wall 16, fans 46 may be positioned at any desired location, such as on the roof of enclosed chamber 12 for directing air downwardly against bundles 24. While chamber 12 has not been illustrated in the drawings as being subjected to a negative or positive pressure, it is to be understood that chamber 12 may be pressurized or subjected to a negative pressure under certain conditions and be utilized with the process of the present invention.

The moisture content of the green wood as set forth herein is determined by the above formula utilizing the wet weight and oven dry weight of the wood. The relative humidity in the air surrounding the wood is determined by a relative humidity meter having a digital readout. A thermometer determines the temperature of the air. The temperature of the wood is determined by a temperature probe embedded in the wood and extending to the center of the wood. Specific humidity levels, time periods, and temperature schedules for specific sizes of specified woods may be predetermined for the cooling fluid and heating fluid after testing.

As a typical example, lumber of uniform size and thickness that has been stickered and stacked in rectangular bundles 24 is loaded within treatment chamber 12. The wood to be treated is green with essentially the same MC that such wood had at the time it was felled, except for possible maximum moisture loss of no more than about 10%. The treatment chamber 12 forming the drying enclosure is stacked with such wood to allow optimum penetration of the heat and steam to all surfaces of the stacked lumber during processing. The chamber 12 is then tightly closed and the heating fluid comprising steam is injected through steam pipe 26 into chamber 12 to fill chamber 12 with saturated steam at a relatively low pressure and velocity. The temperature is elevated to the target temperature, usually about 150° F. with a wet bulb depression as close to "0" as possible and held at that point until the center of the thickest part of the wood has attained such target temperature as determined by an embedded temperature probe. At that point, the wood is held under such conditions for a prescribed period of time depending upon various factors, usually about two (2) hours which is effective also to minimize any staining of the wood.

Next, the heated stickered wood bundles 24 are exposed within treatment chamber 12 to a cooling fluid preferably comprising ambient air from the outside atmosphere received through vents 48. The heated wood is exposed to the cooling fluid within less than about thirty minutes after heating of the green wood. Fans 46 are energized for drawing ambient air in treatment chamber 12 from the outside environment and door 20 for side wall 16 is opened to permit an air flow across chamber 12 which surrounds bundles 24. The ambient air has a temperature (the "flash off temperature") at least about 30° F. below the temperature of the heated wood and a relative humidity (the "flash off RH") at least about 10% less than the RH of the heating chamber 12. For best results, the flash off temperature is at least 50° F. below the temperature of the heated wood and the flash off RH is at least 10% less than the RH of the heated chamber. The ambient air is drawn by fans 46 within treatment chamber 12 and directed by baffles 34 against bundles 24. The wood is rapidly cooled to the temperature of the ambient air in about three (3) to ten (10) hours and has a loss in moisture content of about 5% to 10% when the heated wood is cooled to the temperature of the cooling fluid. Such exposure of the heated green wood to the flash off temperature and the flash off RH can also be accomplished by removing the wood from the heating enclosure or chamber 12 to the outside air, if outside conditions are adequate. After the subject wood has reached an equilibrium with the flash off temperature, then such subject wood may be dried under accelerated conditions based upon the type of species and the desired finished product.

The green wood is exposed to the cooling fluid within a relative short time period after the green wood has been heated to the predetermined target temperature, such as 160° F., for example. For best results, the heated wood is exposed to the cooling fluid as quickly as possible and before the wood loses any substantial heat such as within thirty (30) minutes after the heating step has ended. While treating chamber 12 has been illustrated for the application of the cooling fluid, the heated wood may be placed in the outside environment after heating with natural air comprising the cooling fluid if the outside air has a satisfactory temperature and satisfactory relative humidity for the desired flash off temperature and the flash off humidity. As indicated above, the flash off temperature is at least about 30° F. below the temperature of the heated wood and the flash off humidity is at least 10% below the RH of the heating chamber. During heating of the wood, steam is applied to the heating chamber 12 so that the MC of the wood after heating is substantially the same as the MC of the wood before heating. As a result of the rapid cooling of the wood after heating, the permeability of the green wood is conditioned for obtaining upon further processing increased losses in moisture content relative to present conventional losses until the desired final MC is obtained. As indicated above, a desired final MC for hardwood is between about 5% and 10% and for softwood is between about 15% and 20%. Subsequent processing of green wood after the heating and rapid cooling immediately after heating has resulted in average moisture losses over 4% a day with various additional curing steps.

The process of the present invention has been tested on various species of wood and the following table illustrates the complete drying cycle for green wood from felling of the logs until the final MC of the green wood is achieved. The table is divided into phase 1 and phase 2 of the drying cycle. Phase 1 which includes the flash off step is the initial green wood heating and cooling phase in which heated wood is exposed to a cooling fluid for cooling the heated green wood at least 30° F. and resulting in a moisture loss over at least about 5%. Phase 2 includes the subsequent generally conventional drying steps effective to reduce the MC of the green wood to a predetermined MC in a minimum of time. Phase 2 was tested in a dry kiln which formed the treatment chamber and utilized existing drying or curing steps having high heat with progressively increasing wet bulb depressions. Phase 1 could be utilized as a pre-treatment phase for phase 2. However, with the green wood conditioned by phase 1, increased amounts of moisture were removed by the generally conventional drying steps applied in phase 2 after the completion of phase 1. The table for the drying cycle is a follows:

DRYING TABLE
PHASE 1
INITIAL GREEN WOOD HEATING & COOLING PHASE

| Species of Wood | (A) (1) Shape of Wood To Be Processed (2) Time From Felling Of Log To Process | (B) (1) % MC @ Time Log Felled (2) % MC @ Begin Process | (C) (1) Target Temp. And RH For Flash Off (2) Time Maintained @ Target Temperature | (D) (1) Time Between Heating/Flash Off (2) Temp. & RH Of Cooling Fluid | (E) (1) Time Wood Exposed To Cooling Fluid (2) Velocity of Cooling Fluid in FPM | (F) (1) Loss Of MC After Flash Off (2) Temp. Of Wood After Flash Off |
|---|---|---|---|---|---|---|
| Maple | (1) 5/4 Lumber (11/4%" thick) | (1) 79% MC | (1) 165 Deg. F. 100% RH | (1) 10 Min. | (1) Seven (7) Hours | (1) 8.2% MC Loss |
| | (2) Three (3) days | (2) 76% MC | (2) Three (3) Hours | (2) 80 Deg. F. 70% RH | (2) Ambient Air W/Negl. Velocity | (2) 65 Deg. F. |
| Oak (red) | (1) 4/4 Lumber (1" thick) | (1) 87% MC | (1) 160 Deg. F. 100% RH | (1) 10 Min; | (1) Nine (9) Hours | (1) 8.7% MC Loss |
| | (2) Two (2) Days | (2) 85% MC | (2) Two (2) Hours | (2) 65 Deg. F. 73% RH | (2) Ambient Air W/Negl. Velocity | (2) 65 Deg. F. |
| Pine S. Yellow | (1) 4/4 Lumber (1" Thick) | (1) | (1) 154 Deg. F. 100% RH | (1) 15 Min. | (1) Three (3) Hours | (1) 8.7% MC Loss |
| | (2) 5 (1/2) Days | (2) 110.49% MC | (2) 1.5 Hours | (2) 87 Deg. F. 77.5% RH | (2) Ambient Air W/Negl Velocity | (2) 87 Deg. F. |
| Pine S. Yellow | (1) 8/4 Lumber (2" Thick) | (1) | (1) 154 Deg. F. 100% RH | (1) 15 Min. | (1) Three (3) Hours | (1) 6.2% MC Loss |
| | (2) 5 (1/2) Days | (2) 114.48% MC | (2) 1.5 Hours | (2) 87 Deg. F. 77.5% RH | (2) Ambient Air W. Negl. Velocity | (2) 87 Deg. F. |
| R.R. Ties Oak | (1) 7" × 9" × 9' | (1) 91% MC | (1) 159 Deg. F. 100% RH | (1) 5 Min. | (1) 13 Hours | (1) 6.4% MC Loss |
| | (2) Four (4) Days | (2) 86% MC | (2) Two (2) Hours | (2) 90 Deg. F. 76.4% RH | (2) 150 FPM | (2) 90 Deg. F. |

DRYING TABLE
PHASE 2
SUBSEQUENT DRYING AFTER PHASE 1

| Species of Wood | (G) (1) Dry Bulb Temp. @ Begin Drying (2) Wet Bulb Temp. @ Begin Drying | (H) (1) Dry Bulb Temp. @ End Drying (2) Wet Bulb Temp. @ End Drying | (I) (1) MC @ End of Drying Cycle (2) Average Daily MC Loss During Drying | (J) (1) Total Time For Drying Cycle (2) Total Time From Felling Through Drying |
|---|---|---|---|---|
| Maple | (1) 160 Deg. F. | (1) 160 Deg. F. | (1) 8.2% MC | (1) Four (4) Days |
| | (2) 155 Deg. F. | (2) 125 Deg. F. | (2) 16.95% MC Loss Daily | (2) Six (6) Days |
| Oak | (1) 160 Deg. F. | (1) 160 Deg. F. | (1) 7.4% MC | (1) Six (6) Days |
| (red) | (2) 155 Deg. F. | (2) 125 Deg. F. | (2) 8.48% MC Loss Daily | (2) Eight (8) Days |
| Pine | (1) 170 Deg. F. | (1) 169 Deg. F. | (1) 5.6% MC | (1) Twenty-Three (23) Hours |
| S. Yellow | (2) 169 Deg. F. | (2) 103 Deg. F. | (2) 4.18% Per Hour | (2) Thirty-Five (35) Hours |
| Pine | (1) 170 Deg. F. | (1) 169 Deg. F. | (1) 12.96% MC | (1) Twenty-Three (23) Hours |
| S. Yellow | (2) 169 Deg. F. | (2) 103 Deg. F. | (2) 4.14% Per Hour | (2) Thirty-Five (35) Hours |
| R. R. Ties (oak) | (1) 105 Deg. F. | (1) 105 Deg. F. | (1) 49.8% MC | (1) 8.5 Days |
| 7" × 9" × 9' | (2) 100 Deg. F. | (2) 100 Deg. F. | (2) 3.5% MC Loss Daily | (2) 13 Days |

The test results as set forth in the following table were obtained with heating the green wood in a heated enclosure with steam for a predetermined time period and then removing the heated wood from the enclosure to the outside environment where the ambient air formed the cooling fluid. The ambient air was between 65° F. and 90° F. with a relative humidity between 70% and 80%.

Column I shows the average MC loss during drying under phase 2 ranging from about 3.85% per hour for yellow pine to about 8.48% per day for red oak. Such losses in moisture are substantially higher than MC losses from conventional drying schedules presently utilized. MC losses for hardwood of less than 3% in a 24 hour period, except for southern pine, have been normal as the maximum amount of MC that could be removed without drying defects. The conditioning of the green wood by the heating and cooling steps in phase 1 results in increasing the permeability of the wood for a substantial period of time to permit phase 2 to extract an increased amount of moisture from the wood. While testing has taken place in an enclosed heat kiln for phase 2, increased amounts of moisture have been removed by air drying after the conditioning of the green wood by phase 1 without subsequent heating in a kiln.

The elements for completing a successful flash off step are as follows:

1. The subject wood needs to be as close in MC to being "green" wood or freshly cut wood as possible and having suffered no more than about 10% loss in MC from such green or freshly cut state or condition.
2. The subject wood has to be heated in a heating chamber uniformly throughout its thickness to the target flash off temperature, at least about 120° F. or above, or until the center of the thickest board, beam or pole, as the case may be, is at such target temperature.
3. The subject wood should be held at such target temperature for a predetermined length of time, usually about two (2) hours, especially if a stain prevention benefit is desirable.
4. The subject wood throughout such heating should be maintained as close to a 0 deg. wet bulb depression as possible.
5. The subject wood needs to be exposed to a cooling fluid of reduced temperature (at least 30° F. and preferably 50° F. less than the temperature of the heated wood) and a reduced RH (at least 10% and preferably about 20% less than the RH of the heating chamber).
6. The subject wood needs to be allowed to transfer its internal heat (from the mass or pile) to such reduced flash off temperature and reduced flash off RH environment until it has reached an equilibrium with such reduced temperature.

The cooling fluid may be ambient air or ambient air assisted by the introduction of forced air of the same reduced temperature and reduced RH as the ambient air over the wood bundle. Such forced air can be in the form of artificially reduced temperature and reduced RH from a refrigeration or similar other type of unit for the manufacturing of cooler, drier air as shown in FIG. 1. Testing has shown that the amount of MC given up by the subject wood during the flash off step is directly proportional to the amount of change from the target temperature and RH in the heating chamber to the temperature and RH environment that such processed wood is subjected to during the flash off step.

For further drying of the green wood under phase 2 after phase 1 is completed, the green wood is reheated under conventional dry kiln operations to a predetermined temperature at wet bulb depressions in the 5 deg. to 15 deg. range initially so that the moisture moves very rapidly to the surface of the wood and evaporates into the kiln chamber. As the heating process progresses, the wet-bulb depression is increased to about the 20 deg. to 50 deg. range, depending upon species and various other factors. This is feasible since the green wood processed under phase 1 appears to have undergone an internal conversion. Such conversion results from the bound water either changing into free water, (or assuming) the characteristics of free water. The only precaution to the use of elevated heat and reduced RH is to routinely observe the surface of the wood in the drying unit or kiln to see that it does not become too dry during such processing and subsequently form surface checks. In that situation, the heat or relative humidity ("RH") or both, would need to be moderated briefly until the migration of moisture from the center of each board has caught up with the surface evaporation. Additionally, an adjustment could be made to reduce the wet-bulb depression (increase the RH) which would have virtually the same effect. With this as the only limiting factor, a kiln operator can proceed drying as quickly as possible with a much reduced risk of drying defects of any type. Prior to this invention, the above described conditions in a dry kiln would have caused the wood to have sustained substantial drying defects.

During phase 1 of the drying cycle, the internal forces that are caused by the differential of the surface temperature versus the interior temperature effect certain changes within the cell wall of the wood itself. It is during the flash-off step of phase 1 that such transformation begins. As the high surface moisture begins to evaporate, this in turn, causes a rather rapid reduction of surface temperature of the wood. The rapid surface cooling sets up a temperature/pressure differential that begins a migration of the free water contained within the cells to the surface of the wood. As this free water replaces that surface moisture that is lost to evaporation, it too evaporates thereby further accelerating the cooling effect and increasing such temperature/pressure differential. Within a relatively short period (approx. 10 to 15 minutes depending upon the temperature and RH of the atmosphere where such flash-off occurs) the surface temperature of the wood has approached an equilibrium with the cooling fluid. The internal temperature of such wood is still, however, rather close to the temperature of the heating fluid which is preferably in a range between 120° F. and 190° F.

According to thermodynamics, all elements in nature are either in a state of equilibrium, or such elements are in the process of approaching such state of equilibrium, thereby causing such free water migration as previously stated. Because such free water is located in the internal cavity of the wood cells themselves, then the migration of such water creates a pressure differential within the cell itself. Because of the elevated temperature of the cell wall that would be present at this time, it is believed that an osmotic effect is created making the cell wall more permeable or semi-permeable, thereby causing the bound water contained within the cell walls themselves to begin a migration into the cavity in an attempt on the part of the cell itself, to equalize the displacement of the free water that has migrated to the surface of the wood. This effect, referred to as the "flash off effect" has caused a reduction in MC of the green wood during the cooling step to approach 7% to 10% with no signs of drying degrade or defect. The heated wood is exposed to the cooling fluid within a total time period of about 3 to 10 hours dependent primarily on the wood species and wood size. This amount of moisture loss in such a relatively short time period is substantially higher than obtained heretofore by previous drying processes.

This moisture loss resulting from the flash off effect, although significant in itself, is not as significant as the appearance that the permeability of the cell walls of the processed green wood under phase 1 seems to have been changed permanently to condition the green wood for application of phase 2 of the drying cycle. Phase 2 which utilizes conventional curing steps continues to remove internal moisture in the green wood at an equally impressive rate. It is believed that because the osmotic effect continues to occur as the internal temperature of the processed wood equalizes with the already reduced surface temperature, the permeability of the cell wall is "set" at least for a substantial time period which continues throughout the remaining curing steps of the green wood.

The total time from felling through completion of the drying cycle is of particular importance as being substantially shorter than obtained heretofore with existing conventional drying processes. As shown in column J of the table, the total drying time for maple hardwood after felling was six (6) days and for oak hardwood was eight (8) days. For yellow pine the total drying time was thirty-five (35) hours.

A typical drying cycle for southern yellow pine is shown in the above table. The drying temperature for yellow pine as shown in the table is rather low at about 170° F. due to structural degradation at higher temperature. Therefore, the results do not immediately appear to be unusual. Under present conventional curing processes, southern yellow pine is kiln dried at about 212° F. in about 24 hours (down to about 17% MC). As shown in column J, the total time for phase 2 was twenty-three (23) hours. It should be emphasized that the current industry practice is to use the kiln drying temperature of about 212° F. for yellow pine and to accept any resulting structural degradation or to consider it within acceptable parameters. The present process maintains the structural integrity of the green pine lumber at a drying temperature of 170° F. This is of importance to the pine processing industry. An incidental benefit to the pine and related softwood industry is that the green wood heating and cooling phase of phase 1 provides for the control of fungal and chemical staining that is troublesome to that industry.

Processing of heavy timbers including greater thicknesses has also responded favorably to this invention. The term heavy timbers as used herein shall include, but not be limited to; any lumber thickness over 4 inches (16/4 in the industry jargon), cants, beams and railroad ties. The drying process is performed in relatively the same manner as that of lumber, except the stickering is somewhat different. The stickering sticks are much thicker (sometimes up to 2") and the space between timbers in a pile is wider. The remainder of the process is essentially the same except the processing interval is considerably longer. As shown in the table, railroad ties sized 7"×9"×9' were cut (oak) and pre-treated in the appropriate manner, and then were processed in accordance with this invention. After completing phase 1 of the drying table, the cross ties were reheated at a low temperature of about 105° F. and a low wet bulb depression of about 5 degrees for completing the entire drying cycle from felling to completion of drying in thirteen (13) days.

Cross ties are acceptable with a MC of 50%. By the conventional methods, railroad ties are air-dried for a period of nine (9) months to twelve (12) months, depending upon the geographical location. Through the use of this invention, the total drying time has been shortened to about three (3) to four (4) weeks. On a proportional basis, other heavy timbers will respond as well but with different time schedules. Even under slow controlled conditions of conventional drying methods, ties and other heavy timbers frequently have large and deep checks and cracks. Since such checks and cracks do not appreciably affect the strength of the timbers, they are considered acceptable by the industry. With the drying process of this invention, many of the checks and cracks that develop in heavy timbers do not form since the internal stresses that cause such checks and cracks are removed under phase 1 of this invention.

The drying process of this invention may be utilized to cure wood in the log form for the utility pole, post and related areas by following the same procedure. The obvious exception is that the stacking process is different since round logs of varying diameters are utilized. Stacking and racking methods similar to pipe racks to hold the logs in multi-level rows may be used thereby allowing maximum steam and heat penetration. The actual processing procedure is generally the same as set forth in the table. The drying time is a function of the thickness of the wood being dried. However, the time required for final drying of the logs is substantially reduced from the time needed by present conventional methods.

While phase 1 and phase 2 of the drying process are preferably completed in a single enclosure such as shown in FIG. 1, it may be desirable to have the heating and cooling steps of phase 1 completed at different locations with the heating step being in an insulated enclosure and the cooling step being carried out by open air cooling in an outside atmosphere or environment. The entire accelerated drying process of this invention begins with the felling of the log and ends with the completion of phase 2.

The important feature of the drying process comprises the cooling step of phase 1 referred to as the flash off period. It is during this period that the processed wood develops a complex combination of synchronized changes that make the wood permeable for the entire drying process and ready to be processed by subsequent drying steps. Immediately after the flash off period, the wood must be allowed to return to the atmospheric temperature in which such flash off occurs before proceeding to the accelerated drying cycle as set forth in phase 2.

For carrying out phase 2, the subject wood, in whatever form such subject wood exists, is normally stacked in an insulated chamber for optimum heat and air flow as shown in FIG. 1. With the exception of some species, i.e. pine, etc. where a lower processing temperature is desirable (160 deg. F. or below), the subject wood is heated by means of steam and auxiliary heating to a range of about 150° F. to 180° F. with a wet-bulb depression of anywhere from a 5 degree to 15 degree depression increasing from a 25 degree to 60 degree depression in the later stages of phase 2. The wood, after being subjected to the flash off step in phase 1, is more permeable than heretofore. Some species are more tolerant than others and therefore the temperature and RH need to be moderated based upon species and geographical location of the drying facility. In some instances, the surface moisture will leave the processed wood too quickly before the internal migration of water can catch up with such evaporation. In this case, the operator must either lower the processing temperature or raise the RH, or both, and the situation will be checked. Failure to do this will result in surface checks and other related problems. Random moisture content tests need to be run to signal the approach of the target moisture content which varies for different processed woods. It is recommended that standard oven-dry testing methods be used to augment any electronic meter testing that is done during the process of this invention.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A method for the rapid reduction of the moisture content of green wood utilizing a controlled heating fluid in a confined zone comprising the following steps:

applying the heating fluid at a temperature between about 120° F. and 190° F. to the wood in the confined zone for a predetermined period of time sufficient to provide a generally uniform heating of the green wood, the heating fluid having a predetermined moisture content sufficient to maintain substantially the moisture content of the green wood;

applying a cooling fluid after heating of said green wood for surrounding said green wood, the cooling fluid having a temperature and humidity substantially less than the temperature and moisture content of the heated wood; and maintaining the application of the cooling fluid to said green wood for a predetermined time period sufficient for said wood to reach substantially the reduced temperature of the cooling fluid for the removal of substantial moisture from the green wood.

2. The method as set forth in claim 1 wherein the step of applying a cooling fluid includes applying a cooling fluid having a temperature at least about 30° F. less than the temperature of the heated wood and a relative humidity at least about 10% less than the relative humidity of the heated confined zone.

3. The method as set forth in claim 1 wherein the step of applying a cooling fluid includes applying a cooling fluid having a temperature at least about 50° F. less than the temperature of the heated wood and a relative humidity at least about 20% less than the relative humidity of the heated confined zone.

4. The method as set forth in claim 1 including the step of maintaining the moisture content of the green wood prior to placing the green wood within the confined zone for heating to a moisture loss not greater than 10% of the original moisture content of the wood when felled.

5. The method as set forth in claim 1 wherein the step of applying a cooling fluid includes applying ambient air to said green wood in an environment outside said confined zone.

6. The method as set forth in claim 1 wherein the step of applying a cooling fluid includes applying ambient air as said cooling fluid within an enclosure defining said confined zone for surrounding said green wood with outside ambient air for reducing the temperature and moisture content of said green wood after being heated by said heating fluid.

7. The method as set forth in claim 1 wherein said heating fluid comprises steam for heating and maintaining the moisture content of the green wood.

8. The method as set forth in claim 1 wherein the step of applying cooling fluid to said heated wood is provided within thirty (30) minutes after heating of said wood by said heating fluid.

9. The method as set forth in claim 1 wherein said confined zone comprises an enclosed chamber in which said green wood is positioned and heated by the heating fluid, said chamber being open at least partially to the atmosphere upon application of said cooling fluid to permit heat to escape from said enclosure upon application of said cooling fluid.

10. The method as set forth in claim 9 wherein the applying of said cooling fluid includes the application of artificially cooled air into said chamber having a temperature and humidity substantially less than the temperature and humidity of the heated enclosure.

11. A process for accelerating the drying of green wood comprising the following steps:

sawing wood from a tree containing a moisture content;

heating the wood with a heating fluid in an enclosure to a predetermined temperature at least about 120° F. for a predetermined period of time sufficient to provide a generally uniform heating across the entire cross section of the wood and to maintain substantially the moisture content of the wood during heating;

then exposing the heated wood to a cooling environment containing cooling fluid surrounding said wood of a temperature at least 30° F. less than the temperature of said heated wood and a relative humidity of at least 10% less than the relative humidity of the heated enclosure for the transfer of internal heat and moisture to said cooling fluid;

maintaining the exposure of said wood to said cooling fluid surrounding said wood for a period of time sufficient for the entire cross section of the wood to reach substantially the temperature of the surrounding cooling fluid with substantial moisture being removed from said wood;

then reheating said wood in an enclosure to a predetermined temperature for drying of the wood;

applying moisture within said enclosure to maintain a sufficient moisture content in the outer surface of said wood for minimizing any defects; and maintaining the reheating of said wood for a predetermined time period sufficient to reduce the moisture content of the wood to a predetermined target amount, the wet bulb depression in said enclosure increasing during said reheating of said wood.

12. The process for accelerating the drying of green wood as set forth in claim 11 including the step of sawing lumber from a tree for placing in an enclosure for heating with the lumber having a moisture content that has been reduced an amount less than about 10% of the original moisture content of the tree when felled.

13. The process for accelerating the drying of green wood as set forth in claim 11 including the step of sawing logs from a tree for placing in an enclosure for heating with the logs having a moisture content that has been reduced an amount less than about 10% of the original moisture content of the tree when felled.

14. The process for accelerating the drying of green wood as set forth in claim 11 wherein the step of exposing said wood to a cooling environment includes the application of ambient air to said enclosure.

15. The process for accelerating the drying of green wood as set forth in claim 11 wherein the step of exposing said wood to a cooling environment includes the application of refrigerated air to said enclosure.

16. The process for accelerating the drying of green wood as set forth in claim 11 wherein the step of exposing said wood to a cooling environment including removing said wood from the enclosure and exposing said wood to ambient air forming said cooling fluid.

17. The process for accelerating the drying of green wood as set forth in claim 11 wherein the step of exposing said heated wood to a cooling environment comprising exposing said heated wood to air having a temperature at least 50° F. less than the temperature of said heated wood and a relative humidity of at least 20% less than the relative humidity of the heated enclosure.

18. A process for accelerating the drying of green wood comprising the following steps:

a. sawing wood from a tree containing a moisture content;

b. heating the wood with steam in a heating enclosure to a predetermined temperature at least about 120° F. for a predetermined period of time sufficient to provide a generally uniform heating across the entire cross section of the wood and to maintain the moisture content of the wood during heating;

c. then exposing said wood to a cooling environment containing cooling fluid surrounding said wood of a temperature at least 30° F. less than the temperature of said heated wood and a relative humidity of at least 10% less than the relative humidity of the heating enclosure for the transfer of internal heat and moisture to said cooling fluid;

d. maintaining the exposure of said wood to said cooling fluid surrounding said wood for a period of time sufficient for the entire cross section of the wood to reach substantially the temperature of the surrounding cooling fluid with substantial moisture being removed from said wood; and e. then repeating steps b, c and d in sequence for at least one time to reduce further the moisture content of the wood.

19. The process as set forth in claim 18 wherein said step of exposing said wood to a cooling environment comprises exposing said wood to ambient air.

20. The process as set forth in claim 19 wherein said step of exposing said wood to a cooling environment comprises the transfer of the wood from the heating enclosure to an outside atmosphere containing ambient air.

21. The process as set forth in claim 19 wherein said step of exposing said wood to a cooling environment comprises exposing said wood to ambient air within said heating enclosure.

22. The process as set forth in claim 18 wherein said wood comprises logs.

23. A method for pre-treating green wood to increase the permeability of the wood and to condition the wood for further drying in a kiln; said method comprising:

sawing wood from a tree containing a moisture content that has been reduced a minimum amount from the original moisture content of the tree and is at least about 50%;

heating the wood with steam in a heating enclosure to a predetermined temperature at least about 120° F. for a predetermined period of time sufficient to provide a generally uniform heating across the entire cross section of the wood and to maintain the moisture content of the wood during heating;

then exposing said wood to a cooling environment containing cooling fluid surrounding said wood of a temperature at least 30° F. less than the temperature of said heated wood and a relative humidity less than the relative humidity of the heating enclosure for the transfer of internal heat and moisture to said cooling fluid;

maintaining the exposure of said wood to said cooling fluid surrounding said wood for a period of time sufficient for the entire cross section of the wood to reach substantially the temperature of the surrounding cooling fluid with substantial of moisture being removed from said wood thereby completing the pre-treatment phase; and then transferring the pre-treating green wood to a kiln for completing the drying of said green wood.

24. The method for pre-treating green wood as set forth in class 23 wherein said step of exposing said wood to a cooling environment comprises exposing said wood to ambient air.

25. The method for pre-treating green wood as set forth in claim 24 wherein said step of exposing said wood to a cooling environment comprises the transfer of the wood from the heating enclosure to an outside atmosphere containing ambient air.

26. The process for pre-treating green wood as set forth in claim 23 wherein said step of exposing said wood to a cooling environment comprises exposing said wood to ambient air within said heating enclosure.

27. A method for conditioning green wood to increase the permeability of the wood for further drying; said method comprising sawing wood from a tree containing a moisture content that has been reduced less than 10% from the original moisture content of the tree and is at least about 50%;

heating the wood with steam in a heating enclosure to a predetermined temperature at least about 120° F. for a predetermined amount of time sufficient to provide a generally uniform heating across the entire cross section of the wood and to maintain the moisture content of the wood during heating;

then exposing said wood to a cooling environment containing cooling fluid surrounding said wood of a temperature at least 30° F. less than the temperature of said heated wood and a relative humidity at least 10% less than the relative humidity of the heating enclosure for the transfer of internal heat and moisture to said cooling fluid; and maintaining the exposure of said wood to said cooling fluid surrounding said wood for a period of time sufficient for the entire cross section of the wood to reach substantially the temperature of the surrounding cooling fluid with at least 5% of moisture normally being removed from said wood thereby to condition said green wood for further drying.

28. The method of conditioning green wood as set forth in claim 27 wherein said wood is subjected to further drying by air drying said green wood.

29. The method of conditioning green wood as set forth in claim 27 wherein said green wood is subjected to further drying by heating said green wood in a kiln while gradually increasing the wet bulb depression during heating.

30. The method of conditioning green wood as set forth in claim 27 wherein the step of exposing said wood to a cooling environment including exposing said wood to ambient air of a temperature at least 50° F. less than the temperature of said heated wood and a relative humidity at least 20% less than the relative humidity of the heating enclosure.

31. The method of conditioning green wood as set forth in claim 27 wherein said step of exposing said wood to a cooling environment comprising exposing said wood to a cooling environment within at least 30 minutes after completing heating of said wood.

32. A method for drying railroad cross ties comprising the following steps:

sawing the cross ties from a tree containing a moisture content;

heating the cross ties with steam in a heating enclosure to a predetermined temperature at least about 130° F. for a predetermined amount of time sufficient to provide a generally uniform heating across the entire cross section of the cross ties and to maintain substantially the moisture content of the cross ties during heating;

then exposing said cross ties to cooling fluid surrounding said cross ties of a temperature at least 30° F. less than the temperature of said heated cross ties and a relative humidity of at least 10% less than the relative humidity of the heating enclosure for the transfer of internal heat and moisture to said cooling fluid;

maintaining the exposure of said cross ties to said cooling fluid surrounding said cross ties for a period of time sufficient for the entire cross section of the cross ties to reach substantially the temperature of the surrounding cooling fluid with at least about 5% of moisture normally being removed from said cross ties; and then reheating said cross ties to a low temperature less than about 150° F.

33. The method for drying cross ties as set forth in claim 32 including the step of exposing said cross ties to a cooling environment comprising exposing said cross ties to ambient air within at least 30 minutes after completing the heating of said cross ties.

34. The method for drying cross ties as set forth in claim 32 wherein the step of exposing said cross ties to cooling fluid comprises surrounding said cross ties with ambient air of a temperature at least 50° F. less than the temperature of said heated cross ties.

35. A process of conditioning wood comprising the following steps:

applying a controlled heating fluid at a temperature between about 120° F. and 190° F. to the wood in a confined zone for a predetermined period of time sufficient to provide a generally uniform heating of the wood, the heating fluid having predetermined moisture content sufficient to maintain substantially the moisture content of wood;

applying a cooling fluid after heating of the wood for substantially surrounding the wood, the cooling fluid having a temperature and humidity substantially less than the temperature and moisture content of the heated wood; and maintaining the application of the cooling fluid to the wood for a predetermined time period.

36. The process as set forth in claim 35 wherein the step of applying a cooling fluid includes applying a cooling fluid having a temperature at least about 30° F. less than the temperature of the heated wood and a relative humidity at least about 10% less than the relative humidity of the heated confined zone.

37. The process as set forth in claim 35 wherein the step of applying a cooling fluid includes applying a cooling fluid having a temperature at least about 50° F. less than the temperature of the heated wood and a relative humidity at least about 20% less than the relative humidity of the heated confined zone.

38. The process as set forth in claim 35 wherein the step of applying a cooling fluid comprises applying ambient air from the outside atmosphere.

* * * * *